US005878149A

United States Patent [19]

Hamada et al.

[11] Patent Number: 5,878,149

[45] Date of Patent: Mar. 2, 1999

[54] LOUDSPEAKER HAVING A YOKE, MAGNET, CYLINDRICAL THROAT, AND SPACER PLATE CONFIGURATION

[75] Inventors: Hiroyuki Hamada; Yasushi Tanaka; Akira Tamadera; Toru Iwazumi, all of Saitama-ken, Japan

[73] Assignee: Pioneer Electronic Corporation, Tokyo, Japan

[21] Appl. No.: 967,241

[22] Filed: Nov. 5, 1997

Related U.S. Application Data

[63] Continuation of Ser. No. 712,112, Sep. 11, 1996, which is a continuation of Ser. No. 319,045, Oct. 6, 1994, abandoned.

[30] Foreign Application Priority Data

Oct. 8, 1993 [JP] Japan ..... 5-253363

[51] Int. Cl.[6] ..... H04R 1/02; H04R 1/20; H04R 1/00

[52] U.S. Cl. ..... 381/340; 381/343; 381/412; 381/174; 381/396

[58] Field of Search ..... 381/59, 153, 154, 381/156, 158, 159, 192, 194, 195, 197, 199, 201, 202, 205, 337, 339, 340, 343, 353, 174, 396, 412–413, 430; 181/151, 152, 159, 168, 170, 199

[56] References Cited

U.S. PATENT DOCUMENTS

| | | | |
|---|---|---|---|
| 1,707,544 | 4/1929 | Thuras | 381/194 |
| 2,037,187 | 4/1936 | Wente | 381/199 |
| 3,033,945 | 5/1962 | Villchur | 381/194 |
| 3,196,211 | 7/1965 | Kessenich | 381/193 |
| 3,293,378 | 12/1966 | Heppner | 381/194 |
| 3,780,232 | 12/1973 | Russell | 179/181 |
| 4,152,552 | 5/1979 | Meyer | 381/156 |
| 4,315,102 | 2/1982 | Eberbach | 381/59 |
| 5,014,321 | 5/1991 | Klein | 381/202 |

FOREIGN PATENT DOCUMENTS

| | | | |
|---|---|---|---|
| 654364 | 6/1948 | United Kingdom | 381/154 |

*Primary Examiner*—Curtis A. Kuntz
*Assistant Examiner*—Rexford N. Barnie
*Attorney, Agent, or Firm*—Nikaido, Marmelstein, Murray & Oram LLP

[57] ABSTRACT

A loudspeaker has a yoke having a center hole, a cylindrical magnet mounted on the yoke, a cylindrical pole piece having an inner shoulder portion and mounted on the magnet. A diaphragm is provided above the pole piece, and a cylindrical throat is disposed in the magnet. The yoke has a screw thread formed on an inside wall of the center hole, and the pole piece has a screw thread formed on an inside wall of the shoulder portion. The throat has outer screw threads on an outside wall thereof at an upper portion and a low portion. The outer screw threads are engaged with the screw threads of the yoke and the pole piece. Thus, the magnet is secured to the yoke and the pole piece.

7 Claims, 12 Drawing Sheets

LOUDSPEAKER HAVING A YOKE, MAGNET, CYLINDRICAL THROAT, AND SPACER PLATE CONFIGURATION

This application is a continuation of application Ser. No. 08/712,112, filed Sep. 11, 1996, which in turn is a continuation of application Ser. No. 08/319,045, filed Oct. 6, 1994, now abandoned.

BACKGROUND OF THE INVENTION

The present invention relates to a loudspeaker, and more particularly to an assembling of a horn loudspeaker, thereby improving sound characteristic.

The horn loudspeaker operates to directly propagate sound waves produced at a diaphragm passing through a horn without diffusion. The sound is compressed to be a high sound pressure. Air in the horn operates as resistance to increase radiation resistance and efficiency. The horn loudspeaker has a feature of a high efficiency of change in sound energy. Thus, the horn loudspeaker is widely used in various fields such as home Hi-Fi system and business PA system.

FIG. 11 shows a conventional horn loudspeaker. A horn loudspeaker 10 has a yoke 20 having a center hole 20*b* formed in a yoke base 20*a*, an annular magnet 60 mounted on the yoke base 20*a* around the center hole 20*b*, and an annular pole piece 61 having an inner shoulder portion 61*a* and mounted on the magnet 60. An annular plate 30 having an integral spacer ring 31 is mounted on the pole piece 61 at an upper peripheral portion thereof through the spacer ring 31 and secured to the yoke 20 with screws. A cylindrical throat member 65 made of aluminum and having a tapered through-hole 66 is mounted in the pole piece 61, magnet 60, and center hole 20*b* of the yoke 20. Thus, a magnetic circuit is formed with these elements.

On the plate 30 is mounted an annular frame 35 which supports a diaphragm 50 around an edge 51 thereof. A phasing plug 70 is mounted on a top portion of the pole piece 61 in front of the diaphragm 50. The phasing plug 70 has a center slit 71 and side slits 72 and disposed in a throat portion 65*a* of the throat member 65. Thus, sound waves produced at the diaphragm 50 are propagated in the hole 66 to a mouth portion 75 of the throat member 65 through the slits 71 and 72. A back cover 40 is mounted on the periphery of the plate 30 and secured thereto with screws so as to define a back chamber 45 between the plate 30 and the cover 40.

As shown in FIG. 12, a lower edge of the diaphragm 50 is disposed in a magnetic gap G formed between the pole piece 61 and the plate 30 and secured to a voice coil bobbin 52 having a voice coil 54. The voice coil 54 is disposed in magnetic gap G to be moved in the vertical direction in FIG. 12. The edge 51 of the diaphragm 50 is made of insulation material.

In assembling the magnetic circuit, the throat member 65 is inserted in the center hole 20*b* at the mouth portion 75 and secured thereto with adhesive. The magnet 60 is mounted on the throat member 65 and the pole piece 61 is mounted on the magnet 60 and the shoulder portion 61*a* is secured to the throat member 65 with adhesive. Then, the phasing plug 70 is mounted on the pole piece 61 and the diaphragm 50 secured to the plate 30 through the frame 35 is mounted on the phasing plug 70 and the pole piece 61. The spacer ring 31 of the plate 30 is engaged with the pole piece 61 and secured thereto.

When the magnet 60 is energized, the elements in the yoke 20 are attracted with each other by the magnetic force of the magnet to be fixed to each other. Thus, magnetic loss is reduced.

However, in such a speaker, if the loudspeaker 10 is dropped, the elements fixed to each other with magnetic force may be deflected with shock and the throat member 65 may be removed from the magnetic circuit.

In order to eliminate the disadvantage, elements are adhered to each other with adhesives. However, since the adhesive is non-magnetic material, the magnetic force is prevented from flowing, causing a circuit efficiency to be deteriorated.

If the elements are secured to each other with screws, the magnetic flux becomes irregular because of metallic screws.

SUMMARY OF THE INVENTION

An object of the present invention is to provide a loudspeaker where the assembling of the loudspeaker is improved, thereby improving the quality of reproduced sound.

According to the present invention, there is provided a loudspeaker having a yoke having a center hole, a cylindrical magnet mounted on the yoke, a cylindrical pole piece having an inner shoulder portion and mounted on the magnet, a diaphragm provided above the pole piece, and a cylindrical throat disposed in the magnet, comprising, the yoke having a screw thread formed on an inside wall of the center hole, the pole piece having a screw thread formed on an inside wall of the shoulder portion, the throat having outer screw threads on an outside wall thereof at an upper portion and a low portion, both of the outer screw threads being engaged with the screw threads of the yoke and the pole piece, whereby the magnet is secured to the yoke and the pole piece.

The diaphragm is connected to a ground through a conductive material.

The other objects and features of this invention will become understood from the following description with reference to the accompanying drawings.

DETAILED DESCRIPTION OF THE PREFERRED EMBODIMENTS

Figure 1:
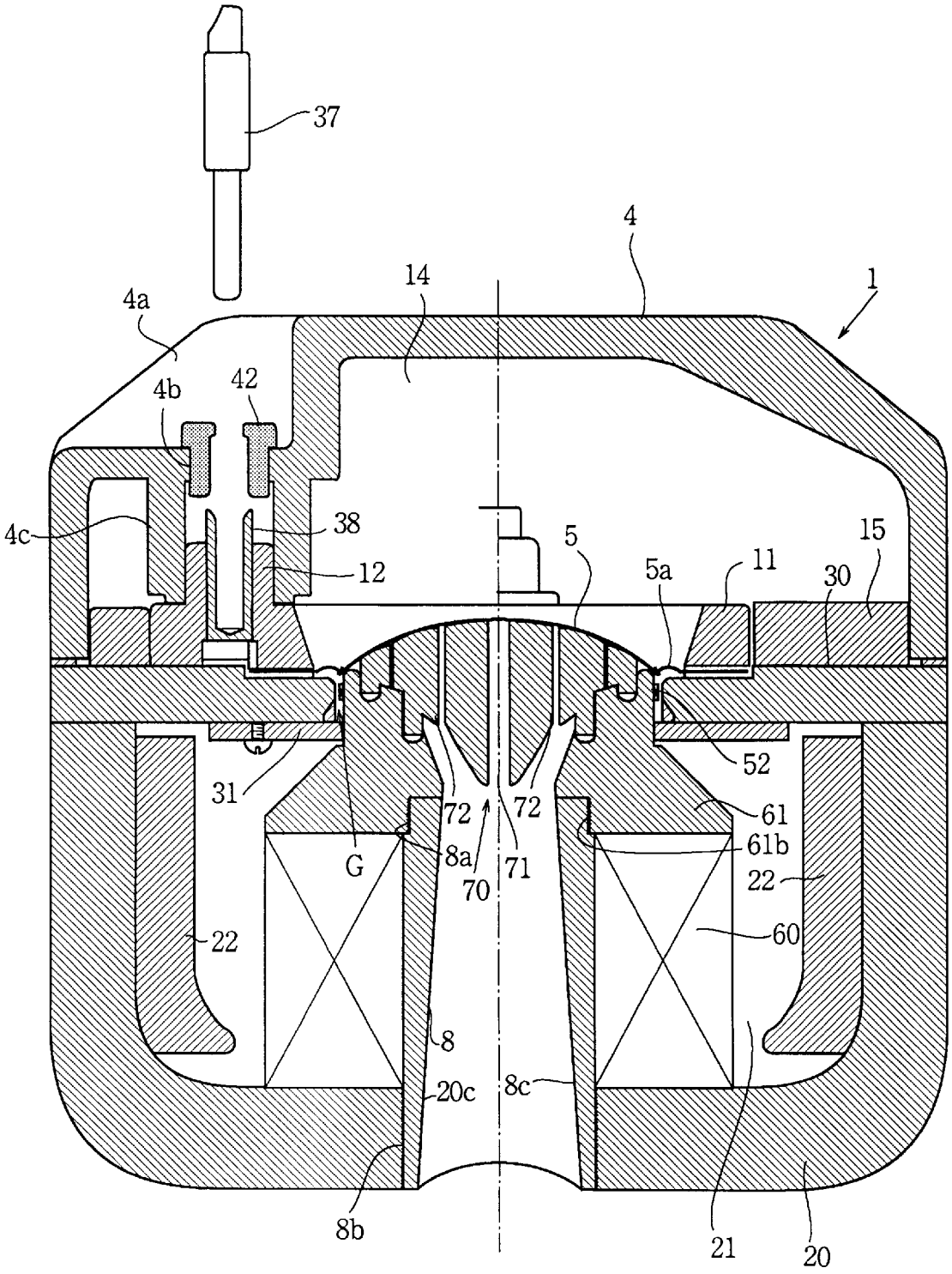
FIG. 1 is a sectional view showing a loudspeaker of the present invention.
Figure 11:
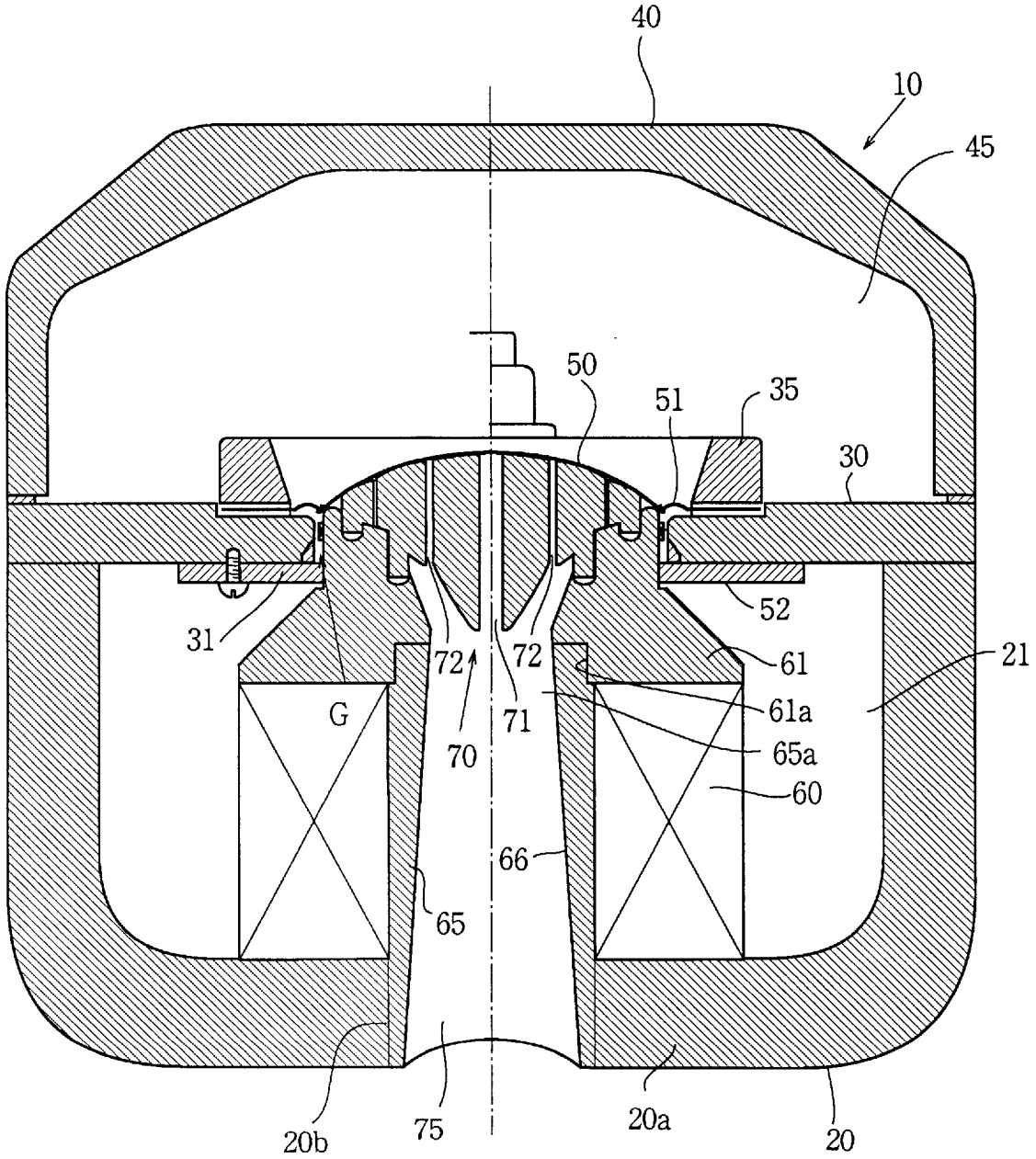
FIG.11 PRIOR ART
FIG. 11 is a sectional view showing a conventional loudspeaker.
Figure 12:
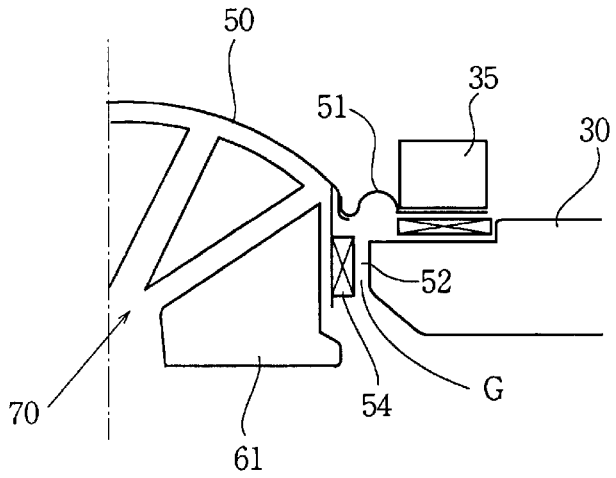
FIG.12 PRIOR ART
FIG. 12 is an enlarged side view showing a part of a magnetic circuit of the conventional loudspeaker.

Referring to FIG. 1 showing a born loudspeaker of the present invention, structures which are the same as the conventional one are identified with the same reference numerals as FIGS. 11 and 12.

A horn loudspeaker 1 comprises the yoke 20 having a U-shaped section, a cylindrical magnet 60, and a cylindrical pole piece 61 having an inner shoulder portion. A screw thread 20*c* is formed on an inside wall of a center hole of the yoke 20, and a screw thread 61*b* is formed on an inside wall of the shoulder portion of the pole piece. The plate 30 having the spacer ring 31 is mounted on the pole piece 61 and secured to the yoke 20 in the same manner as the conventional speaker. A sound absorbing material 22 is mounted on a inside wall of the yoke 20 for absorbing a standing wave produced in a space 21 of the yoke.

A cylindrical throat member 8 made of aluminum and having a through-hole 8*c* has outer screw threads 8*a* and 8*b* formed on opposite end portions thereof. The thread 8*a* engages with the thread 61*b* of the pole piece 61 and the thread 8*b* engages with the thread 20*c* of the yoke 20. The phasing plug 70 is mounted on the pole piece 61.

A diaphragm 5 made of metal is mounted on the plate 30 and supported by an annular frame 11 at an edge 5*a*. The coil bobbin 52 connected to the diaphragm 5 is disposed in the gap G.

Figure 3:
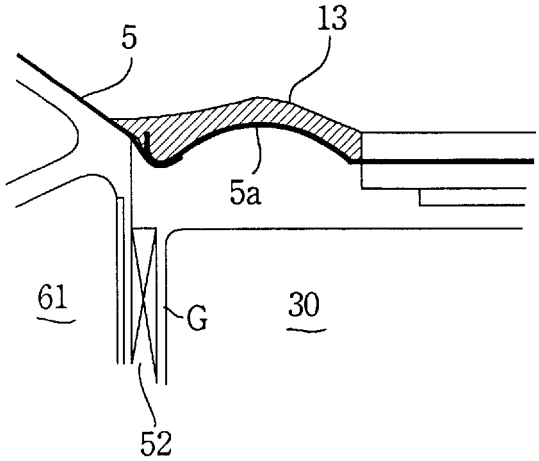
FIG. 3 is an enlarged side view showing a part of a magnetic circuit of the loudspeaker.
Figure 4:
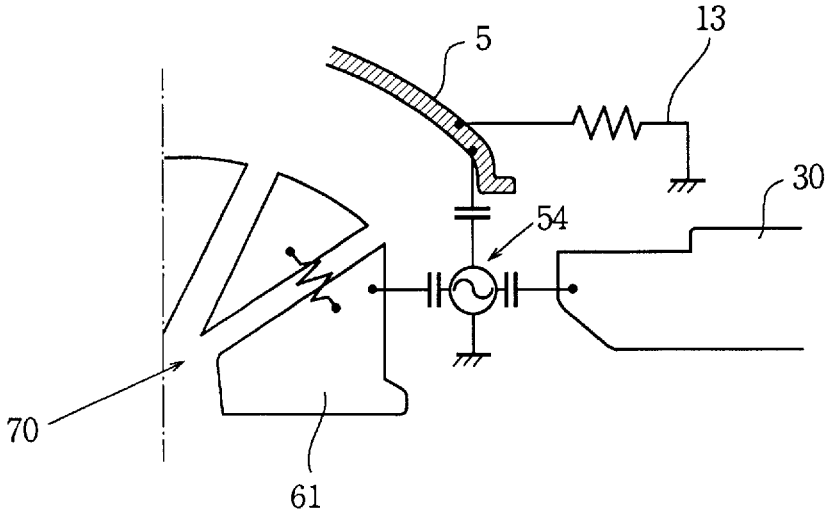
FIG. 4 is an enlarged side view showing an electric connection of the magnetic circuit of FIG. 3.

Referring to FIGS. 3 and 4, the edge 5*a* of the diaphragm 5 is coated with a coating layer 13 such as electrical conductive foil or paste. The diaphragm 5 is connected to the ground through the coating layer 13. Thus, electric potential of the diaphragm 5 is equal to a minus terminal of the voice coil 54.

Figure 14:
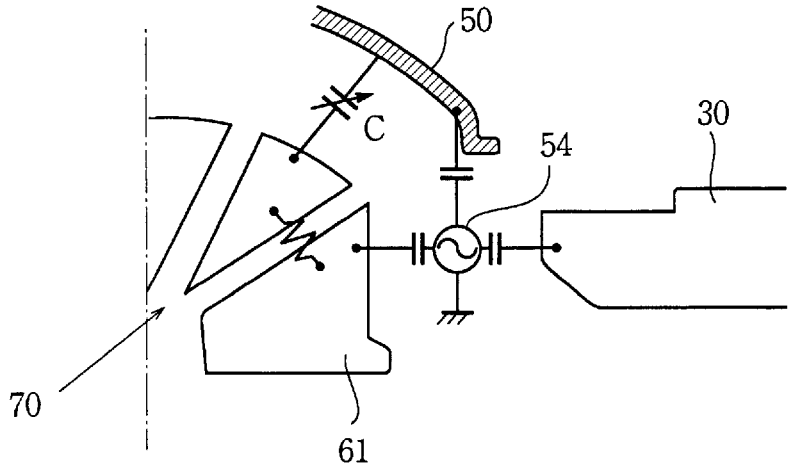
FIG.14 PRIOR ART
FIG. 14 is an enlarged side view showing an electric connection of the conventional magnetic circuit.

FIG. 14 shows the diaphragm 50 and the voice coil 54 of the conventional speaker. Since the edge 51 (FIG. 12) of the diaphragm 50 is made of insulation material, a stray capacity C is produced between the diaphragm 50 and the phasing plug 70 when audio current is applied to the voice coil 54. Accordingly, a high frequency enters the voice coil through the stray capacity C, causing a reproduced sound to be unstable to deteriorate the sound quality.

In the present invention, the stray capacity C is not formed.

Referring to FIG. 1, a back cover 4 is secured to the plate 30 so as to define a back chamber 14. A high-density sound absorbing material 15 is provided in a space between the frame 11 and the inside wall of the back cover 4, which will be described hereinafter in detail.

Figure 5:
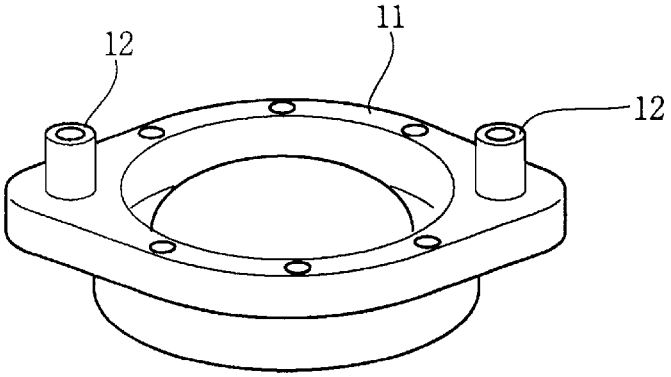
FIG. 5 is a perspective view showing an annular frame.

FIG. 5 shows the frame 11 which has a pair of cylindrical portions 12 formed opposite to each other.

Figure 2:
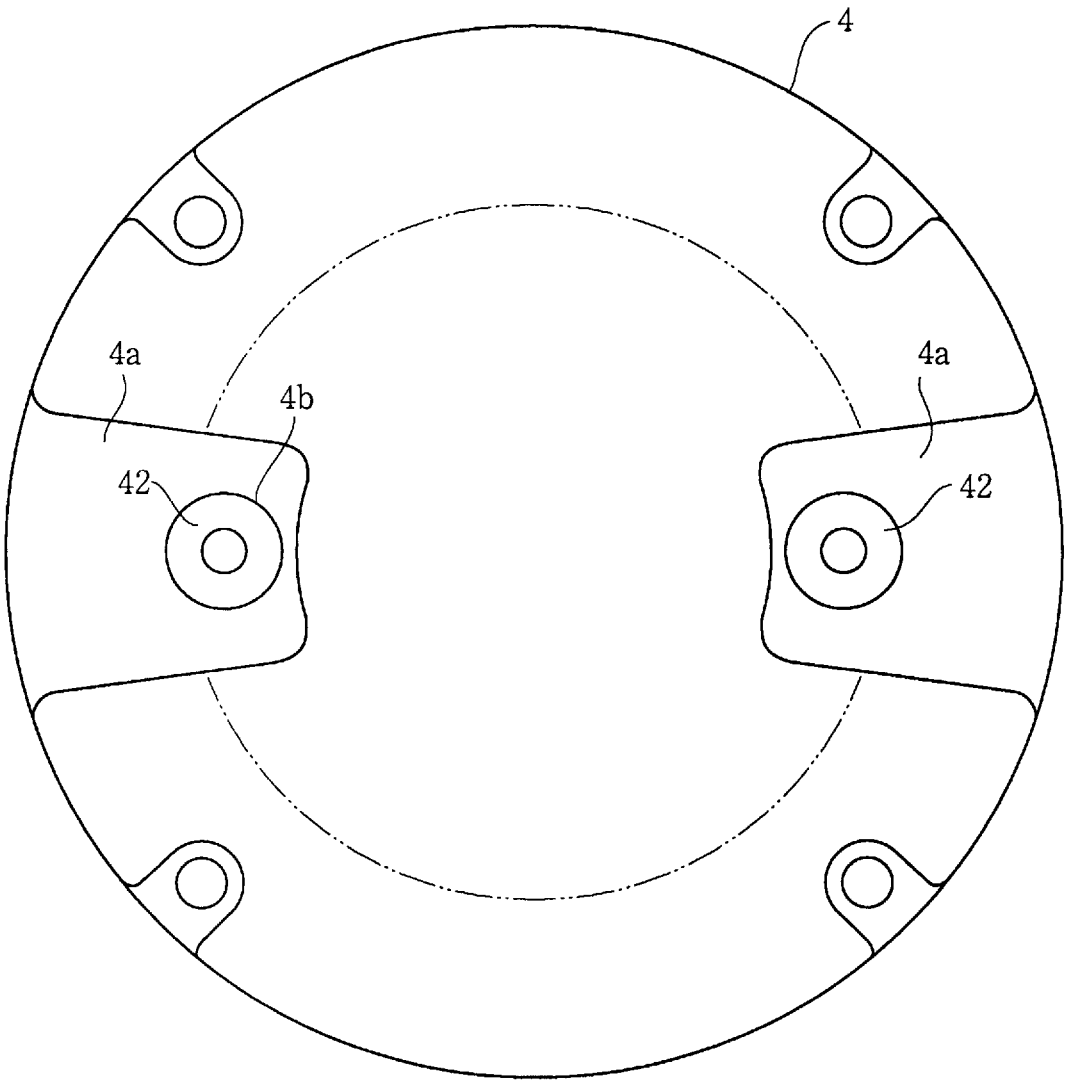
FIG. 2 is a plan view of the loudspeaker as viewed at the rear.
Figure 6:
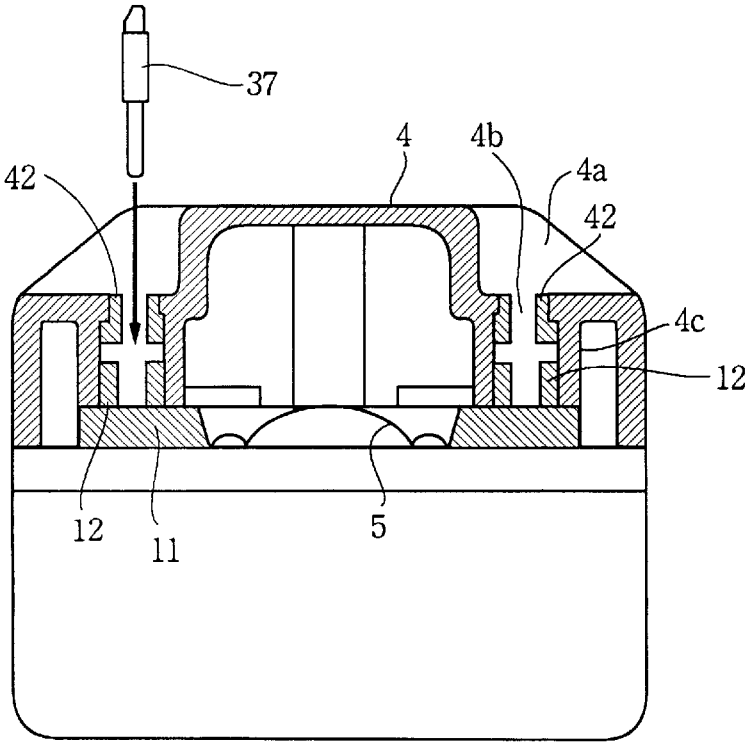
FIG. 6 is a sectional view schematically showing a back chamber of the loudspeaker.

A shown in FIGS. 2 and 6, the back cover 4 has a pair of recesses 4*a* formed opposite to each other corresponding to the cylindrical portions 12 of the frame 11. Each recess 4*a* has an opening 4*b* and an inner hub 4*c* provided adjacent to the opening 4*b* to the opening 4*b* to be engaged with the cylindrical portion 12 of the frame 11. A bush 42 made of rubber is engaged with the opening 4*b*.

A supply terminal 38 (FIG. 1) is mounted in the cylindrical portion 12 of the frame 11. An external terminal 37 is inserted into the opening 4*b* of the cover 4 through the bush 42 and engaged with the supply terminal 38 in the cylindrical portion 12. By the bush 42, the terminal 37 is prevented from vibrating in the terminal 38.

Figure 13:
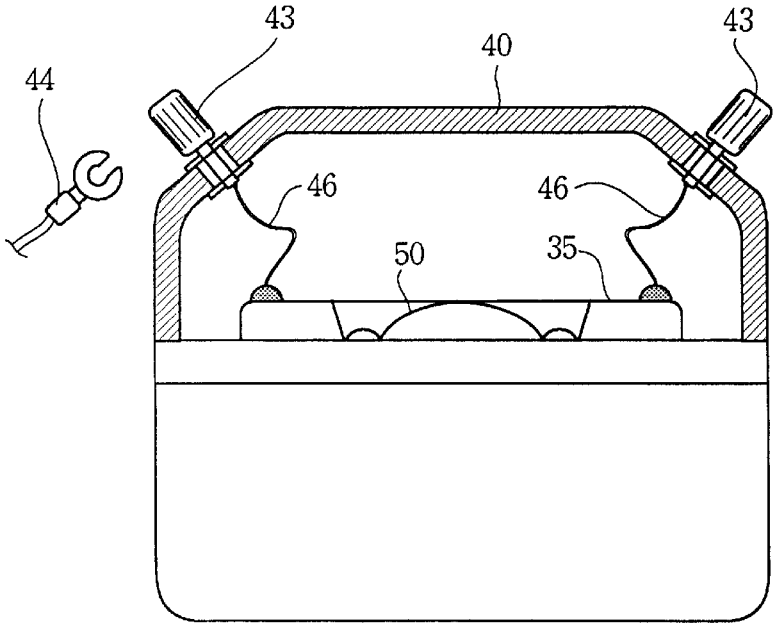
FIG.13 PRIOR ART
FIG. 13 is a sectional view showing a power supply of the conventional loudspeaker.

As shown in FIG. 13, the conventional loudspeaker has input terminals 43 provided on the back cover 40. A lead 46 connected to the input terminal 43 is connected to the frame 35. A speaker code 44 is connected to the input terminal 43. If the lead 46 is vibrated in accordance with sound pressure in the chamber, noises are produced to deteriorate the sound quality.

In assembling the magnetic circuit, the thread 8*a* of the throat member 8 is engaged with the thread 61*b* of the pole piece 61 so that the throat member 8 is secured to the pole piece 61. The throat member 8 with the pole piece 61 is inserted in the magnet 60 and the thread 8*b* is engaged with the thread 20*c* of the yoke 20. The throat member 8 is secured to the yoke 20. Thus, the pole piece 61 and the yoke 20 are firmly pressed against both ends of the magnet 60.

When the magnet 60 is energized, magnetic flux is larger than the saturation of magnetic elements. Thus, the magnetic flux is prevented from circulating in the circuit, with an effective energization.

Figure 7:
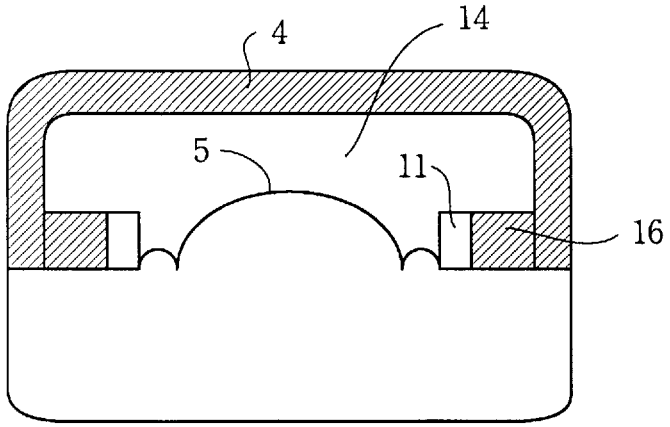
FIG. 7 is a schematic diagram showing an example of a back chamber.
Figure 8:
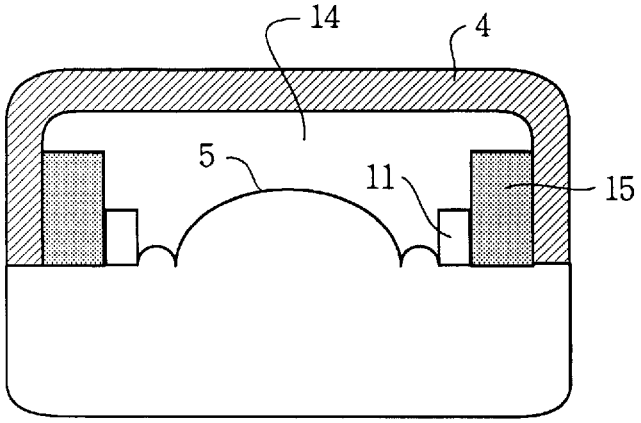
FIG. 8 is a schematic diagram showing another example of a back chamber.

FIGS. 7 and 8 show examples of assembling of the annular frame 11. In the back chamber 14, a hard material member 16 or high-density sound absorbing material 15 is provided in a space between the frame 11 and the inside wall of the back cover 4. The material is mounted at an equal level with or a higher level than the frame 11. The density of the material 15 is 0.2 or more.

Figure 9:
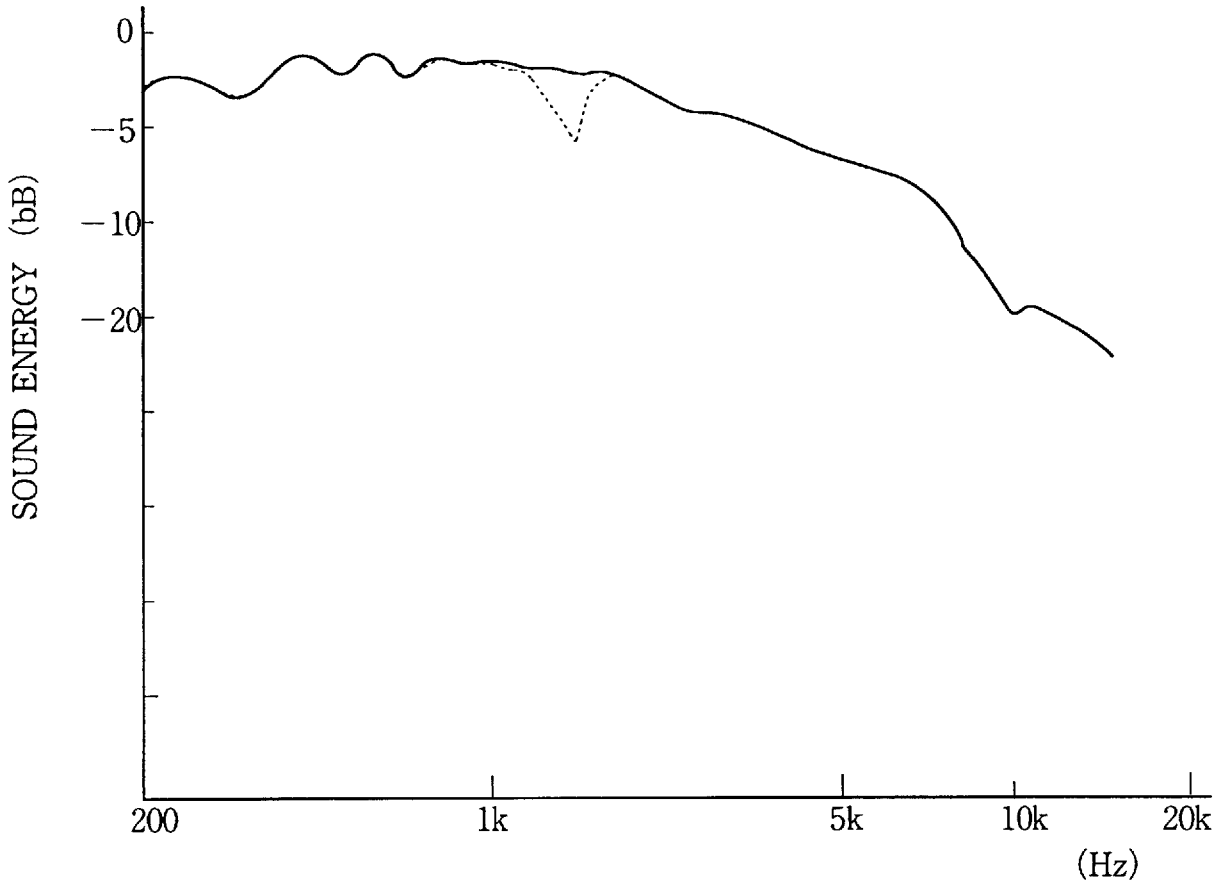
FIG. 9 is a diagram showing a frequency characteristics with respect to sound energy.

FIG. 9 shows a frequency characteristic of the loudspeaker. The frequency characteristic is improved as shown by a solid line. If the density of the material 15 is smaller than 0.2, a dip will occur at 1.5 kHz as shown by a dotted line.

Figure 15:
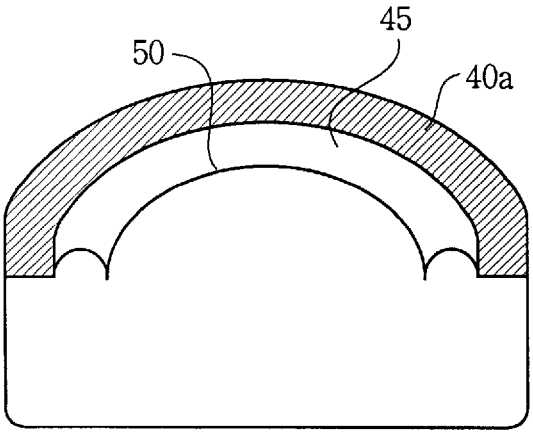
FIG.15 PRIOR ART
FIG. 15 is a schematic diagram showing a conventional back chamber.

FIG. 15 shows a conventional back cover 40*a* which directly supports the diaphragm 50. Accordingly, a space of the back chamber 45 is very small.

Figure 16:
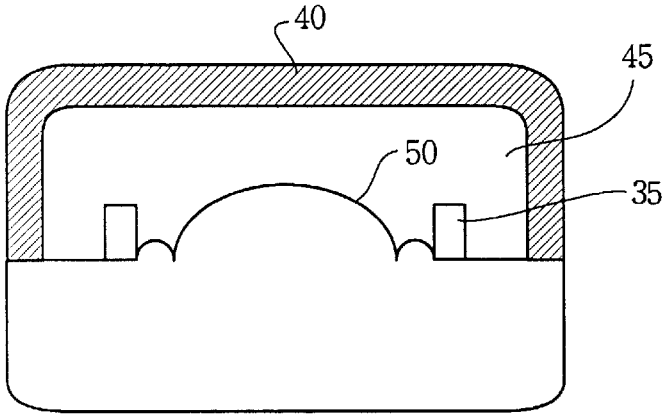
FIG.16 PRIOR ART
FIG. 16 is a schematic diagram showing another conventional back chamber.

FIG. 16 shows the back cover 40 of the conventional speaker for increasing a space in the back chamber.

Figure 17:
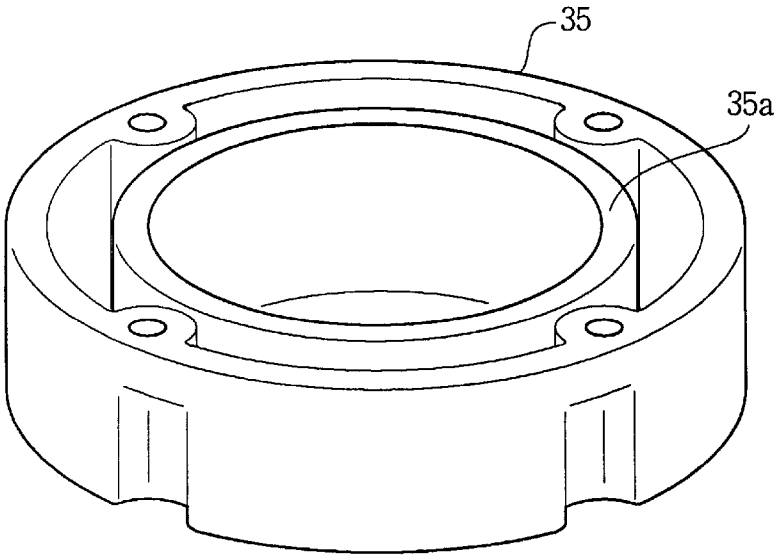
FIG.17 PRIOR ART
FIG. 17 is a perspective view showing a conventional annular frame.

Therefore, it is necessary to provide the annular frame 35 having an annular hub 35*a* as shown in FIG. 17. The edge of the diaphragm 50 is firmly engaged with the hub 35*a*. Since the frame 35 is projected in the back chamber 45, the projected portion causes resonance. As shown in FIG. 9, the frequency characteristic is dipped at 1.5 kHz as shown by the dotted line.

Figure 10:
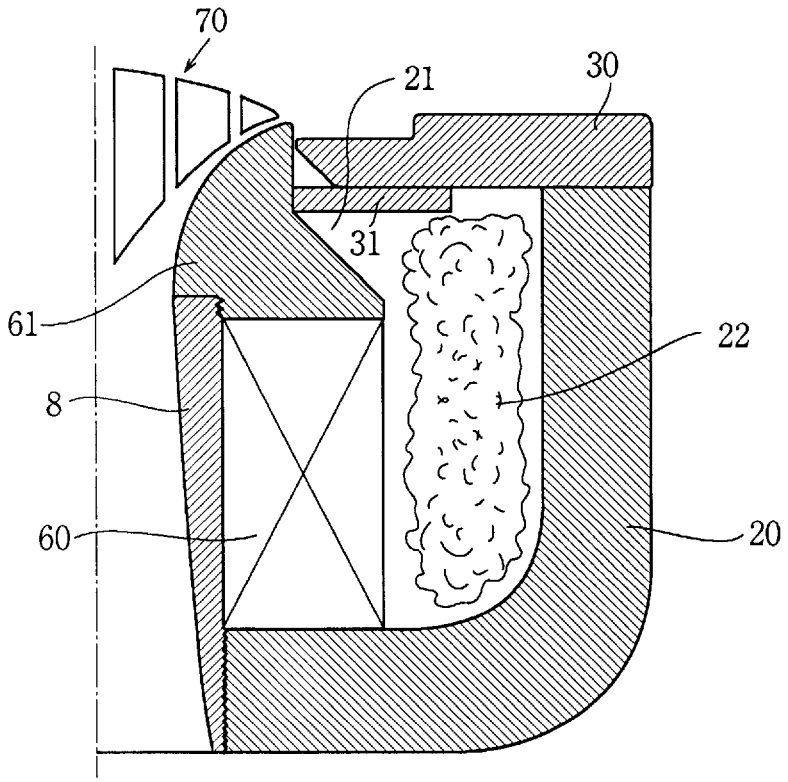
FIG. 10 is a sectional view showing a part of a yoke of the loudspeaker.

As shown in FIG. 10, the space 21 in the yoke 20 is closed by the yoke 20, magnet 60, pole piece 61, center ring 31, and plate 30. The standing wave which is easily produced is absorbed by the sound absorbing material 22.

Figure 18:
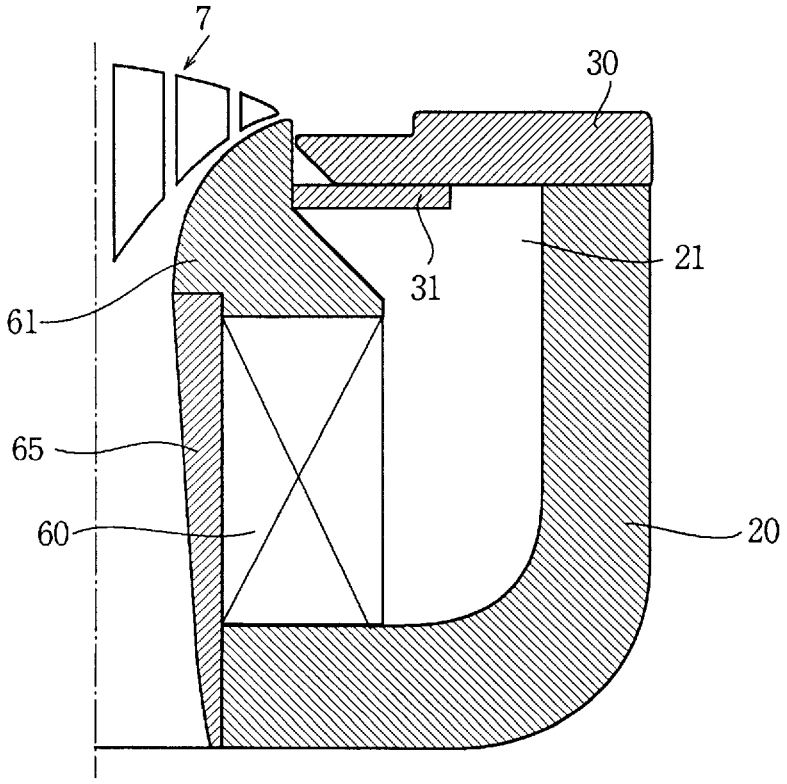
FIG.18 PRIOR ART
FIG. 18 is a sectional view showing a part of a conventional yoke.

FIG. 18 shows the conventional yoke 20 without sound absorbing material 22. By the standing wave, accompanying sounds are produced, which affects the reproduced sound.

In accordance with the present invention, the magnet is firmly mounted in the yoke between the yoke and the pole piece through the throat member. Even if the loudspeaker is dropped, the elements of the magnetic circuit is prevented from deflecting. Since the magnetic loss is reduced, the quality of reproduced sound is improved.

While the presently preferred embodiments of the present invention has been shown and described, it is to be understood that these disclosures are for the purpose of illustration and that various changes and modifications may be made without departing from the scope of the invention as set forth in the appended claims.

What is claimed is:

1. A loudspeaker having a yoke having a center hole, a cylindrical magnet mounted on the yoke, a cylindrical pole piece having an inner shoulder portion and mounted on the magnet, a diaphragm provided above the pole piece, and a cylindrical throat disposed in the magnet, comprising:

the yoke having a screw thread formed on an inside wall of the center hole;

the pole piece having a screw thread formed on an inside wall of the shoulder portion;

the throat having outer screw threads on an outside wall thereof at an upper portion and a low portion;

both of the outer screw threads being engaged with the screw threads of the yoke and the pole piece, wherein the magnet is secured to the yoke and the pole piece, and wherein the outer screw threads of the low portion of the throat are in screwed engagement only with the inner screw threads of the yoke for securing the throat to the yoke.

2. A loudspeaker having a yoke having a center hole, a cylindrical magnet mounted on the yoke, a cylindrical throat disposed in the magnet and secured to the yoke, a cylindrical pole piece mounted on the magnet, and secured to the throat, a diaphragm provided above the pole piece, an annular plate secured to an upper end of the yoke, said loudspeaker comprising:

a spacer plate secured to an underside of the annular plate so as to close a gap between an outer periphery of the pole piece and an inner periphery of the annular plate to form a closed space in the yoke;

a first sound absorbing material mounted in the closed space;

a back cover to cover the diaphragm;

a second sound absorbing material mounted in a space within the back cover; and a phasing plug secured to the pole piece at a front side of the diaphragm, the diaphragm being directly connected to a ground through a conductive material.

3. A loudspeaker having a yoke having a center hole, a cylindrical magnet mounted on the yoke, a cylindrical throat disposed in the magnet and secured to the yoke, a cylindrical pole piece mounted on the magnet, and secured to the throat, a diaphragm provided above the pole piece, an annular plate secured to an upper end of the yoke, said loudspeaker comprising:

a spacer plate secured to an underside of the annular plate so as to close a gap between an outer periphery of the pole piece and an inner periphery of the annular plate to form a closed space in the yoke;

a first sound absorbing material mounted in the closed space;

a back cover to cover the diaphragm;

a second sound absorbing material mounted in a space within the back cover; and a phasing plug secured to the pole piece at a front side of the diaphragm, the diaphragm being connected to a ground through a conductive material, wherein said back cover includes an opening therein, said opening including a rubber bush and a supply terminal provided in the opening, said bush being configured to prevent an external terminal engaged with the supply terminal from vibrating.

4. A loudspeaker as recited in claim 2, further comprising an annular frame secured to an upper side of the annular plate so as to hold a peripheral portion of the diaphragm.

5. The loudspeaker according to claim 2, wherein the conductive material for the connection of the diaphragm to the ground is a conductive foil or paste coated on an edge of the diaphragm.

6. The loudspeaker according to claim 4, wherein the second sound absorbing material is disposed in a space between an outer wall of the frame and an inner wall of the back cover as to fill the space with the sound absorbing material.

7. The loudspeaker according to claim 6, wherein the sound absorbing material has a height higher than the frame.

* * * * *